United States Patent [19]

McMillan

[11] Patent Number: 4,761,885

[45] Date of Patent: Aug. 9, 1988

[54] SHARPENER FOR COMPASS LEADS AND PENCIL LEADS

[76] Inventor: Colin W. McMillan, 173 St. Lawrence Crescent, Saskatoon, Saskatchewan, Canada, S7K 3X7

[21] Appl. No.: 44,667

[22] Filed: May 1, 1987

[51] Int. Cl.[4] ..... B43L 23/00

[52] U.S. Cl. ..... 30/451; 30/453; 30/457; 144/28.11

[58] Field of Search ..... 30/451, 453, 454, 455, 30/457, 462; 144/28.11, 28.2

[56] References Cited

U.S. PATENT DOCUMENTS

| | | | |
|---|---|---|---|
| 575,947 | 1/1897 | Hart | 30/455 |
| 2,230,936 | 2/1941 | Collins | 30/452 |
| 2,242,458 | 5/1941 | Dessonnaz | 144/28.1 |
| 2,653,576 | 9/1953 | Slattery | 30/455 |
| 2,895,453 | 7/1959 | Jones, Jr. | 30/455 |
| 3,223,073 | 12/1965 | Mamin | 144/28.1 |
| 3,667,516 | 6/1972 | GrosJean | 30/454 |

*Primary Examiner*—Frederick R. Schmidt
*Assistant Examiner*—Maurina Rachuba
*Attorney, Agent, or Firm*—Stanley G. Ade; Adrian D. Battison; Murray E. Thrift

[57] ABSTRACT

A conventional means for sharpening leads consists of a flat stick covered with abrasive paper strips that do not prevent lead residue from falling out onto desks, equipment, hands and drawings. Cone shaped lead sharpeners are known but when used for compass leads, they are most easily used if held substantially horizontally and of which circumstances the residue of the pencil lead dust and the like still spills out. The present device includes a fixed, inverted truncated sharpening cone held in a container by means of a retainer ring having a residue trapping collar formed under the ring and adjacent the upper end of the sharpening cone. This residue then falls downwardly into the open based cone into the base of the container when placed in the upright storage position.

21 Claims, 2 Drawing Sheets

Fig. 1
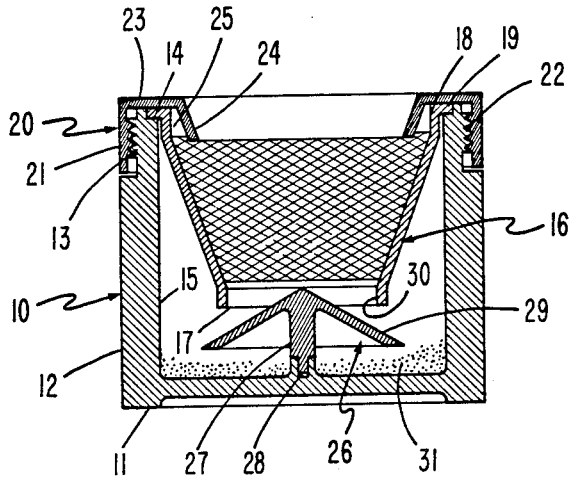
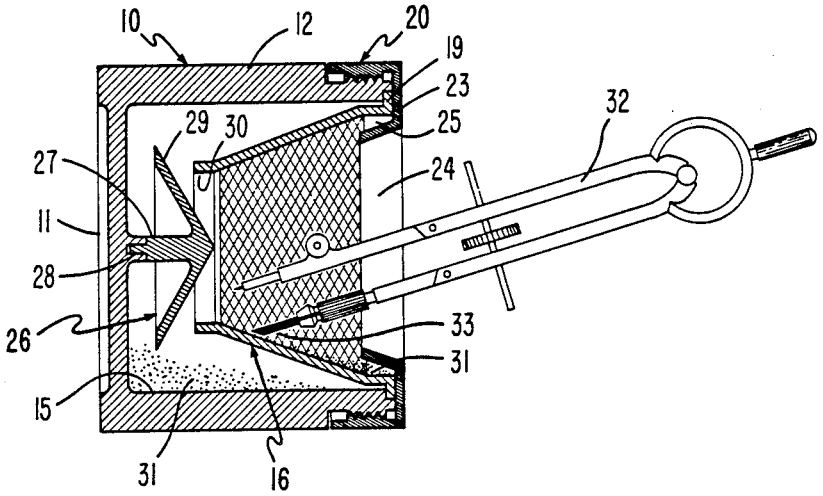
Fig. 2

SHARPENER FOR COMPASS LEADS AND PENCIL LEADS

BACKGROUND OF THE INVENTION

This invention relates to new and useful improvements in sharpening devices specifically designed for use with compass leads but of course it will be appreciated that it can be used to sharpen or point pencil leads as well.

Conventionally, compass leads are sharpened upon a flat stick covered with an abrasive surface whereupon the black lead residue or dust spills from the strip onto the hands of the use, onto the equipment and often onto the drawing on the table or desk adjacent the user.

Although cone shaped sharpeners are known, when used for compass leads particularly, they are usually held substantially horizontally where once again the lead residue is easily spilled from the sharpener during use.

The present invention overcomes these disadvantages by providing a fixed cone shaped sharpener held in a container and having a retainer ring around the upper end thereof which retains the lead dust or residue as it is being formed. When the sharpener is then placed in the upright storage position, this residue slides down the sharpening cup and into the base where it may be deflected outwardly clear of the base so that it cannot spill when the sharpener is next used.

One aspect of the invention is to provide a device for sharpening compass leads and the like as per claim 1. Another advantage is that when the sharpener is held in the substantially horizontal position for use in sharpening a pencil or compass lead, any residue existing in the container is trapped between the outside of the cone and the retainer ring holding the cone in position within the container.

A still further advantage of the invention is to provide a device of the character herewithin described which is simple in construction, economically manufactured and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 1 is a cross sectional view of the sharpener in the upright or storage position.

FIG. 2 is a view similar to FIG. 1 but showing the sharpener held in the sharpening position with a compass lead engaged therewith.

In the drawings like characters of reference indicate corresponding parts in the different figures.

DETAILED DESCRIPTION

Figure 3:
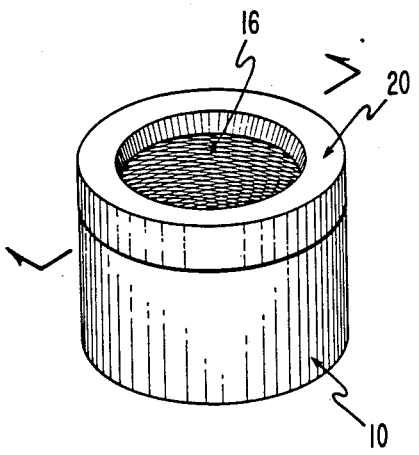
FIG. 3 is an isometric view of the assembled device.

Proceeding therefore to describe the invention in detail, reference to the accompanying drawings will show a substantially open topped cylindrical container 10 having a base 11 and a surrounding wall 12.

The upper outer side of the surrounding wall is recessed and screw threaded as shown at 13 and an annular shoulder 14 is formed at the base of an annular recess on the upper end of the inner surface 15 of the annular wall 12.

An inverted truncated cone shaped sharpening cup collectively designated 16 is provided with an open base 17 and an open upper end 18. This is provided with an out-turned horizontally extending annular flange 19 which seats within the recess and onto the shoulder 14 so that the upper surface of the flange is substantially flush with the upper surface of the annular wall 12.

A retaining ring collectively designated 20 includes an annular wall 21 which is screw threaded internally which is screw threadably engaged with the upper screw threaded portion 22 of the annular wall 12. This retainer ring includes the horizontal flange 23 which clamps the annular flange 19 of the cup, between the horizontal flange 23 and the shoulder 14 when the retainer ring is screwed downwardly upon the upper open end of the container 12.

A downwardly and inwardly inclined flange 24 extends from the inner edge of the horizontal flange 23 in the form of a bevelled inside edge to the retainer ring and this defined a residue catching annular channel 25 between the inside surface of the upper end of the sharpening cup and the inner surface of the bevelled flange 24.

A deflector assembly collectively designated 26 consists of a stem 27 engageable within an aperture 28 situated centrally upon the base 11 of the container and a cone shaped deflector 29 extends from the upper end of stem 27 outwardly and downwardly and beyond the annular wall 30 defining the open base of the inverted truncated cone forming the sharpening cup. The cone 29 is spaced above the base 11 of the container and below the lower open end of the cone 16 so that debris flows downwardly upon the inner surface of the cup and is deflected outwardly into the base as indicated by reference character 31, when the container is in the upright or stored position shown in FIG. 1. In use, the container is held substantially horizontally whereupon the compasses indicated by reference character 32 are held as shown with the compass lead 33 engaging the inner surface of the cone which is provided with an abrasive for sharpening leads of the pencils or compasses.

The compass is moved from side to side to form the desirable conventionally curved surface on the outer side of the distal end of the lead 33 with the residue falling into the recess 25 as clearly shown.

When the container is returned to the upright position shown in FIG. 1, this debris or dust flows downwardly and is deflected outwardly into the base of the container as clearly shown.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A device for sharpening compass leads and the like comprising in combination an open topped container, an open based sharpening cup mounted in said container means to detachably mount said cup in said container and a cup retaining ring detachably engaged with the upper end of said container, means cooperating between the upper edge of said cup and the inner edge of said retainer ring to trap lead residue therein when sharpening a compass lead or the like, when said container is in the tilted operating position and means to direct said residue into the base of the container when the container is in the upright storage position.

2. The device according to claim 1 in which said means to detachably mount said cup in said container includes an outwardly turned flange at the upper end of said cup, said flange registering on the upper side of said container, said retainer ring having an open annular horizontal flange portion clamping said flange of said cup between said retainer ring and said upper end of said container.

3. The device according to claim 2 which includes a downwardly recessed annual shoulder formed in the upper end of said container, said flange of said cup registering within said recess and upon said shoulder.

4. The device according to claim 3 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

5. The device according to claim 4 in which said cone shaped deflector includes a stem extending upwardly from substantially the centre of said base of said container, said cone shaped deflector being mounted on said stem and being held spaced above said base of said container but spaced below the open base of said sharpening cup.

6. The device according to claim 3 in which said means cooperating between the upper edge of said cup and the inner edge of said retaining ring includes a flange on said retaining ring inclining inwardly and downwardly with the inner perimeter of said last mentioned flange defining an open, upper end of said sharpening cup.

7. The device according to claim 6 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

8. The device according to claim 7 in which said cone shaped deflector includes a stem extending upwardly from substantially the centre of said base of said container, said cone shaped deflector being mounted on said stem and being held spaced above said base of said container but spaced below the open base of said sharpening cup.

9. The device according to claim 2 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

10. The device according to claim 9 in which said cone shaped deflector includes a stem extending upwardly from substantially the centre of said base of said container, said cone shaped deflector being mounted on said stem and being held spaced above said base of said container but spaced below the open base of said sharpening cup.

11. The device according to claim 2 in which said means cooperating between the upper edge of said cup and the inner edge of said retaining ring includes a flange on said retaining ring inclining inwardly and downwardly with the inner perimeter of said last mentioned flange defining an open, upper end of said sharpening cup.

12. The device according to claim 1 in which said cup in in the form of an inverted truncated cone, and a lead sharpening surface on the inside of said cup.

13. The device according to claim 12 in which said means cooperating between the upper edge of said cup and the inner edge of said retaining ring includes a flange on said retaining ring inclining inwardly and downwardly with the inner perimeter of said last mentioned flange defining an open, upper end of said sharpening cup.

14. The device according to claim 13 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

15. The device according to claim 12 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

16. The device according to claim 15 in which said cone shaped deflector includes a stem extending upwardly from substantially the centre of said base of said container, said cone shaped deflector being mounted on said stem and being held spaced above said base of said container but spaced below the open base of said sharpening cup.

17. The device according to claim 1 in which said means cooperating between the upper edge of said cup and the inner edge of said retaining ring includes a flange on said retaining ring inclining inwardly and downwardly with the inner perimeter of said last mentioned flange defining an open, upper end of said sharpening cup.

18. The device according to claim 17 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

19. The device according to claim 18 in which said cone shaped deflector includes a stem extending upwardly from substantially the centre of said base of said container, said cone shaped deflector being mounted on said stem and being held spaced above said base of said container but spaced below the open base of said sharpening cup.

20. The device according to claim 1 in which said means to direct said residue into the base of said container includes the lower open base of said cup being situated spaced upwardly from the base of said container and a cone shaped deflector extending upwardly from said base of said container and centralized in the open base of said cup to deflect the residue outwardly and beyond the periphery of said open base of said cup.

21. The device according to claim 20 in which said cone shaped deflector includes a stem extending upwardly from substantially the centre of said base of said container, said cone shaped deflector being mounted on said stem and being held spaced above said base of said container but spaced below the open base of said sharpening cup.

* * * * *